United States Patent [19]

Jondahl

[11] Patent Number: 4,895,001

[45] Date of Patent: Jan. 23, 1990

[54] EXPANDABLE REFRIGERATION SYSTEM

[76] Inventor: Joseph S. Jondahl, 9305 S. College, Unit 304, Tulsa, Okla. 74137

[21] Appl. No.: 324,724

[22] Filed: Mar. 17, 1989

[51] Int. Cl.[4] ..... F25B 27/00

[52] U.S. Cl. ..... 62/326; 62/329; 62/298; 62/441; 62/449; 312/236

[58] Field of Search ..... 62/440, 441, 449 R, 62/465, 329, 298, 326 O; 312/214, 236

[56] References Cited

U.S. PATENT DOCUMENTS

| | | | |
|---|---|---|---|
| 2,534,272 | 12/1950 | Kleist | 62/329 |
| 2,554,290 | 5/1951 | Becker | 62/329 |
| 3,590,594 | 7/1971 | Arend | 62/329 X |
| 3,712,078 | 1/1973 | Maynard et al. | 62/326 X |
| 3,977,467 | 8/1976 | Northrup, Jr. | 62/326 X |
| 4,457,140 | 7/1984 | Rastelli | 62/261 |
| 4,505,126 | 3/1985 | Jones et al. | 62/329 X |

*Primary Examiner*—Lloyd L. King
*Attorney, Agent, or Firm*—Head & Johnson

[57] ABSTRACT

An expandable refrigeration system for use in dispensing products to the public, the system including a base unit with a product containing chamber, a refrigeration system in the base unit and having a compressor and condenser portion and a fan for moving ambient air past the condenser, an evaporator cabinet supported adjacent the refrigeration system having an evaporator therein which is connected to the compressor and condenser of the refrigeration system and a fan for moving air past the evaporator whereby the air is coated, openings through which cooled air from the evaporator is conducted into the base unit product containing chamber, a slave unit having a product containing chamber contiguous with the base unit, first and second ducts communicating the interior of the base unit product containing chamber with the slave unit product containing chamber so that cooled air circulated in the base unit is also circulated in the slave unit allowing the addition of increased product containing space without an additional refrigeration system.

6 Claims, 2 Drawing Sheets

EXPANDABLE REFRIGERATION SYSTEM

SUMMARY OF THE INVENTION

Refrigerated space is frequently used for dispensing products to the public. Such space is used for dispensing cold drinks, fruit juice, sandwiches, packaged ice cream and so forth. In the very competitive, and rapidly changing field of consumer product services, it is frequently necessary to add additional refrigeration space for new products, or to delete refrigeration space when products not requiring refrigeration become popular. Units which have product containing chambers from which consumer products can be dispensed are self-contained units, each with its own refrigeration system. Such self-contained units are inherently expensive and are typically not of the configuration needed to easily add additional product containing space.

The present invention provides a means of adding to a base unit additional refrigerated product containing chambers in a way which can be accomplished most expeditiously and inexpensively and utilizing slave product containing chambers which are not required to have separate refrigeration systems. For this purpose, the present invention utilizes a base unit having a product containing chamber normally accessed by a door opened by the purchasing public. Positioned above the base unit is a refrigeration system having a compressor and a condenser. A fan is provided for moving ambient air past the condenser. In addition, positioned on the base unit is an evaporator cabinet having an evaporator therein, the evaporator being connected to the compressor and condenser of the refrigeration system. A fan is provided within the evaporator cabinet for moving chilled air past the evaporator.

Passageways are provided for directing chilled air flowing past the evaporator from the evaporator cabinet into a first portion of the base unit product containing chamber. A separate passageway provides air from a second portion of the base unit product containing chamber back to the evaporator cabinet. In this way, cooled air flowing past the evaporator and the evaporator cabinet is directed into the base unit product containing chamber and the air is recirculated from the product containing chamber back through the evaporator cabinet.

Secured adjacent and preferably contiguous to the base unit is a slave unit having a product containing chamber which is accessed by a door. The slave unit, like the base unit, is utilized for dispensing refrigerated products to the public. A first duct communicates with the interior of the slave unit product containing chamber with the base unit product containing chamber first portion; that is, the portion which receives chilled air from the evaporator cabinet. A second duct communicates with the interior of the salve unit product containing chamber with the base unit second portion. In this manner cooled air is circulated both in the base unit interior product containing chamber and the slave unit product containing chamber without requiring a separate refrigeration system for the slave unit. This arrangement permits inexpensive addition of product containing space without requiring an additional refrigeration system.

The slave unit can be quickly and expeditiously attached when needed. When a slave unit is removed from attachment to a base unit, the ducts are closed so that no loss of refrigerated air from the base unit occurs.

The invention is easily adaptable for use of either one or two slave units. In addition, to increase the circulation of chilled air from the base unit through the slave units, each of the slave units may be supplied with an auxiliary fan to augment the air circulation.

One means of employing the principles of this invention is in a base unit designed for use on a counter on which a microwave oven is also needed. In this case, the base unit has an opening in the lower portion thereof to receive a microwave with one or more doors above the microwave space providing access into the base unit refrigerated product containing chamber. One or more slave units may be utilized with such system with the slave unit having full height of the base unit including the height of the microwave containing portion of the base unit.

For reference to prior art concerning modular refrigeration systems, U.S. Pat. No. 4,457,140 is relevant. This patent shows a modular refrigeration unit and cabinet system, but in which the refrigeration system forms a modular portion. This contrasts with the present invention is which the refrigeration system is a part of the base unit and in which slave units are employed which do not require refrigeration systems.

A better understanding of the invention will be had by reference to the following description and claims taken in conjunction with the attached drawings.

DESCRIPTION OF THE PREFERRED EMBODIMENT

Figure 1:
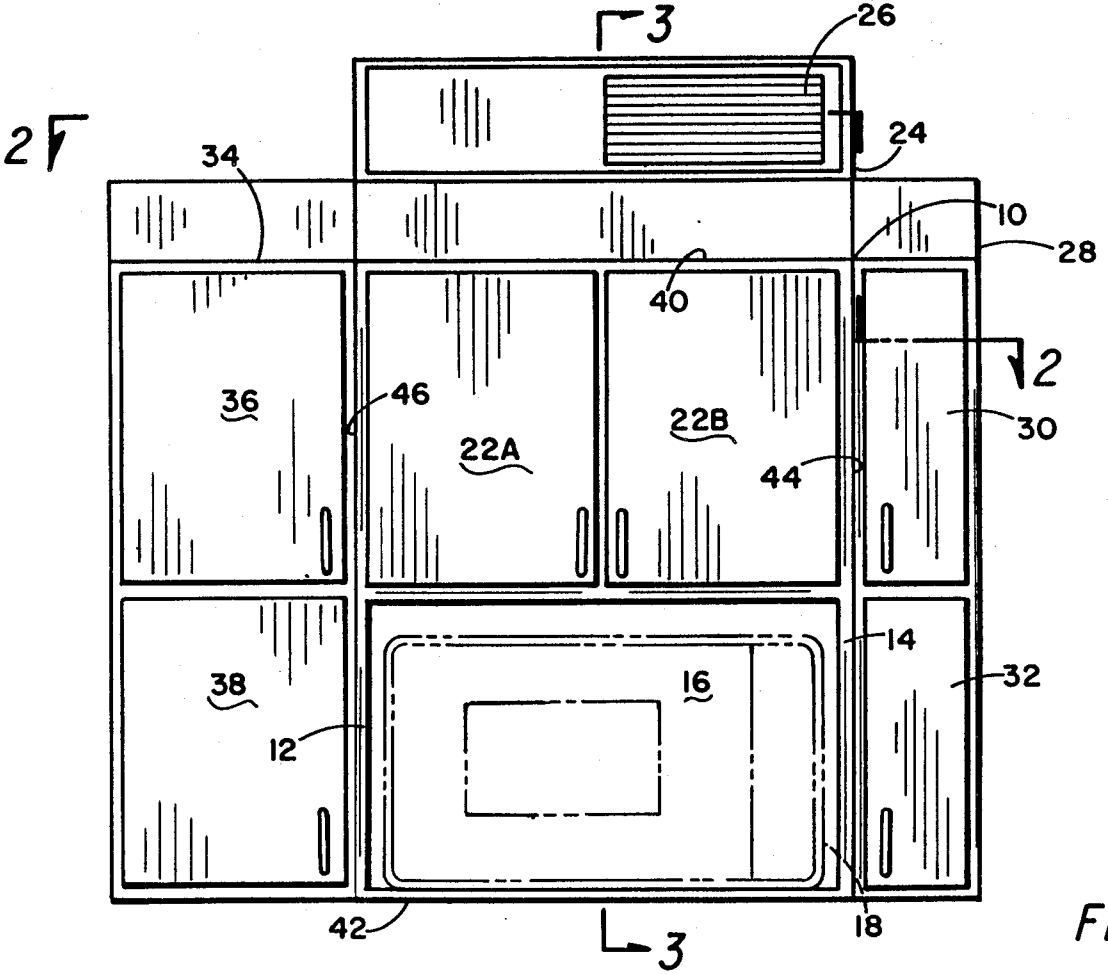
FIG. 1 is an elevational front view of an expandable refrigeration system employing the principles of this invention.

Referring to the drawings and first to FIG. 1, the front view of a system employing the principles of this invention is illustrated, it being understood that the actual appearance of the system employing the invention may be considerably different than that illustrated as a preferred embodiment. In FIG. 1 a base unit is indicated by the numeral 10. The base unit has side walls 12 and 14 providing an open space 16 adaptable to receive a portable apparatus such as a microwave oven 18, shown in dotted outline as an example. The unit illustrated in FIG. 1 is configured for placement on a counter top 20 although it can be seen that the unit can be self-standing, however, utilization of the principles of the invention for dispensing consumer products which must be cooled is best illustrated by the device configured for mounting on the counter top 20.

The base unit 10 has doors 22A and 22B which provide access by the purchasing public to the interior of the unit, the interior of the unit being a product containing chamber. Supported above the base unit 10 is a refrigeration system housing 24 having an air passage grill 26.

The base unit 10 described to this point is not entirely unlike modular refrigeration systems available to contain products which are dispensed to the public such as through doors 24A and 24B. A unique feature of the invention is the employment in conjunction with the base unit 10 of slave units which provide inexpensive expandable means of dispensing products to the public. On the right hand of the base unit 10 is a first slave unit 28 which has an upper door 30 and a lower door 32. The height of the first slave unit 28 is substantially the same as that of the base unit 10 except that the refrigeration system housing 24 may be of increased height as is illustrated.

A second slave unit 34 is secured to the base unit 10 and has an upper door 36 and lower door 38 similar to first slave unit 28. The slave units 28 and 34 are substantially identical except that the second slave unit 34 is illustrated as being wider to indicate that slave units of varying widths may be employed to add increased flexibility in the use of the concepts of this invention.

The slave unit doors 30, 32, 36, and 38 may be of the full size as illustrated or only small doors to provide access to products dispensed on inclined trays. The actual arrangement for dispensing products from both the base unit 10 and the slave units 28 and 34 may vary according to the specific type of product being dispensed. The commonality of the products dispensed, however, is that they are of the type which require refrigeration.

Base unit 10 has a top 40, a bottom 42, a first side wall 44 and a second side wall 46. These parts are identified since they will be referred to later.

Figure 3:
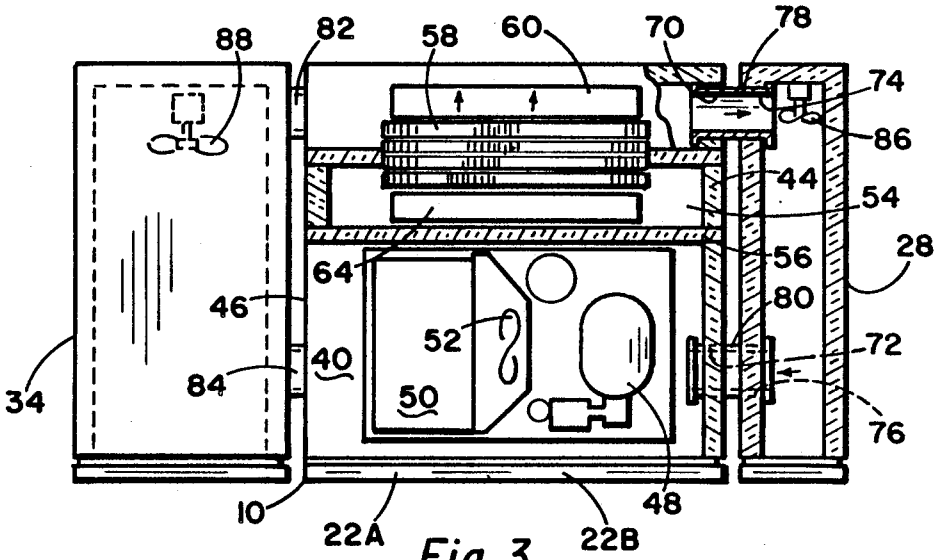
FIG. 3 is an elevational cross-sectional view taken along the line 3—3 of FIG. 2.
Figure 2:
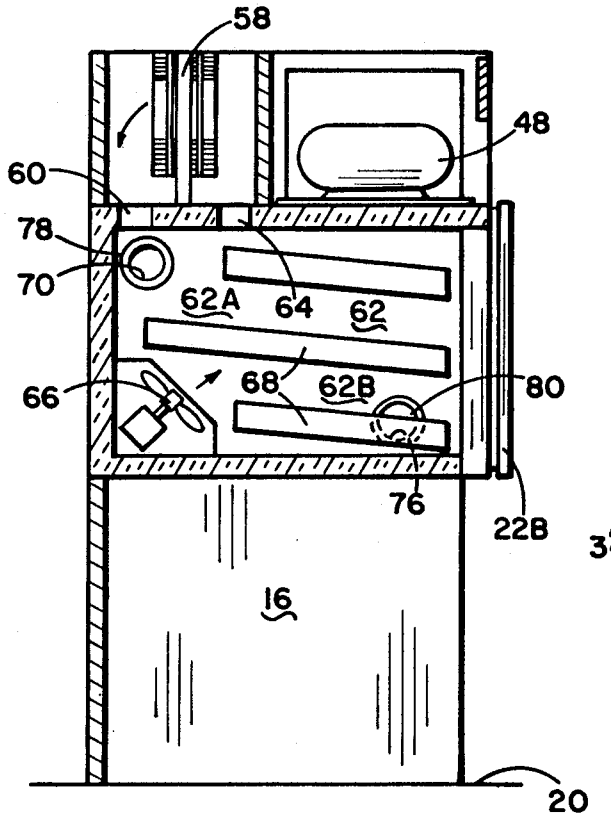
FIG. 2 is a horizontal view taken in two planes of the expandable refrigeration system of FIG. 1.

Refer now to FIGS. 2 and 3. These cross-sectional views illustrate more details of the exemplified embodiment of the invention.

FIG. 2 is a cross-sectional view taken through two horizontal planes. The base unit supports a refrigeration system which includes a compressor 48, a condenser 50, a fan 52 for moving ambient air past the condenser, an evaporator cabinet space 54, which is separated from the other refrigeration system by a wall 56, and, within the evaporator cabinet space 54, an evaporator coil 58. These components are shown resting on the base unit top 40. An air discharge opening 60 is provided within the top 40 which communicates with the interior of the base unit, the interior being a product containing chamber 62. A second or return air opening 64 is also provided in the base unit top 40.

Air flows past the evaporator coil 58, through discharge opening 60 into a first portion 62A of the product containing chambers 62. As shown in FIG. 3, the air moves as indicated by the arrows within the product containing chamber first portion 62A and is circulated by fan 66 into the full interior of the product containing chamber 62, and into a second portion 62B thereof.

Thus, it can be seen that the air cooled by movement through evaporator 58 is drawn into and circulated within the product containing chamber 62. FIG. 3 shows the use of shelves 68 as an example of the type of dispensing system which may be employed within the product containing chamber 62.

Base unit 10 is capable of use along since it is a self-contained unit and is particularly adaptable for placement on a counter which normally is occupied by a microwave oven or some comparable unit; and in this manner the base unit provides additional opportunity for the distribution of refrigerated products, such as sandwiches, cold drinks, ice cream and so forth. However, the base unit may be expanded by the use of one or both of the slave units 28 and 34. As shown in FIG. 2, the master unit side walls 44 and 46 have air passageway openings therein, the openings in side wall 44 being identified by the numerals 70 and 72. The openings in the left side wall 46 are not seen. The salve units have corresponding openings and the openings in slave unit 28 are identified by the numerals 74 and 76. A conduit 78 communicates opening 70 in the base unit and with opening 74 in the slave unit; and a second conduit 80 communicates opening 72 in the base unit with opening 76 in the slave unit. In like manner, openings are provided in the base unit left wall 46, although not seen in the drawings. Matched openings are provided in the wall of second slave unit 34, but those openings are also not seen. These sets of openings are connected by a third conduit 82 and a fourth conduit 84.

Slave unit 28 has an air distributing fan 86 arranged to cause movement of chilled air from first conduit 78, through the interior of the slave unit, and back into the base unit through second conduit 80. In this way, chilled air from the base unit is utilized to cool the contents of the slave unit. In like manner, the second slave unit 34 has a fan 88 to circulate chilled air in the second slave unit in the same way.

When the base unit 10 is used along, conduits 78, 80, 82 and 84 are not employed and the openings in the side walls, including openings 70 and 72, are closed. When it is desirable to install a slave unit, the operator merely removes such temporary closures and installs conduits 78 and 80 if only first slave unit 28 is employed; and conduits 82 and 84 if second slave unit 34 is also employed. Thus, the operator can add additional display and merchandise distribution containers without requiring additional refrigeration capacity. The slave units are therefore economically constructed since no refrigeration equipment is required of them and yet they permit a great deal of flexibility in the arrangement of container space for products which must be refrigerated.

The invention thus provides a unique system for use by retailers to distribute refrigerated products and allows the retailer to have a great deal of flexibility in the system for housing such products for access to the purchasing public. Slave units can be easily and quickly added or removed according to trends and business.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An expandable refrigeration system for use in dispensing products to the public, comprising:

a base unit having a product containing chamber;

a refrigeration system having a compressor and a condenser supported adjacent said base unit and a fan for moving ambient air past said condenser;

an evaporator cabinet supported adjacent said refrigeration system and said base unit and having an evaporator therein, and means connecting the flow of refrigerant between said compressor, said condenser and said evaporator;

fan means for moving air past said evaporator;

means to direct air flowing past said evaporator into a first portion of said base unit product containing chamber and means for returning air from a second portion of said base unit product containing chamber to said evaporator whereby air is chilled by said evaporator and is circulated through both said portions of said base unit product containing chamber;

a slave unit having a product containing chamber, the slave unit being contiguous with said base unit;

first duct means communicating the interior of said slave unit product containing chamber with said base unit product containing chamber first portion; and a second duct means communicating the interior of said slave unit product containing chamber with said base unit product containing chamber second portion whereby chilled air is circulated within said slave unit product containing chamber.

2. An expandable refrigeration system according to claim 1 including a second slave unit having a product containing chamber and being contiguous said base unit;

a third duct means communicating the interior of said second slave unit product containing chamber with said base unit product containing chamber first portion; and fourth duct means communicating the interior of said second slave unit product containing chamber with said base unit product containing chamber second portion whereby chilled air is circulated within said second slave unit product containing chamber.

3. An expandable refrigeration system according to claim 1 including auxiliary means within said slave unit arranged to augment the circulation of air within said first slave unit product containing chamber from said first duct means and out through said second duct means.

4. An expandable refrigeration system according to claim 2 including a first auxiliary fan means within said first mentioned slave unit and a second auxiliary fan means within said second mentioned slave unit, both said auxiliary fan means being arranged to augment the circulation of air from said base unit through said respective slave unit product containing chambers.

5. An expandable refrigeration system according to claim 1 wherein said base unit has a top, a front having at least one door therein providing access to said product containing chamber, and opposed sides, and including an open space below said product containing chamber and between said opposed sides adaptable to receive an apparatus, such as a microwave oven therein.

6. An expandable refrigeration system according to claim 5 wherein said refrigeration system compressor and condenser portions are supported above said base unit top.

* * * * *